US008603214B2

(12) United States Patent
Kientzler et al.

(10) Patent No.: US 8,603,214 B2
(45) Date of Patent: Dec. 10, 2013

(54) MODIFYING FLUX FOR MOLTEN ALUMINIUM

(75) Inventors: Philippe Kientzler, Paris (FR); Kerstin Loebbers, Ramsdorf (DE); Laurent Michard, Versailles (FR)

(73) Assignee: Foseco International Limited, Derbyshire (GB)

( * ) Notice: Subject to any disclaimer, the term of this patent is extended or adjusted under 35 U.S.C. 154(b) by 14 days.

(21) Appl. No.: 12/735,183

(22) PCT Filed: Dec. 22, 2008

(86) PCT No.: PCT/GB2008/004250

§ 371 (c)(1),
(2), (4) Date: Aug. 30, 2010

(87) PCT Pub. No.: WO2009/081157

PCT Pub. Date: Jul. 2, 2009

(65) Prior Publication Data

US 2011/0185850 A1 Aug. 4, 2011

(30) Foreign Application Priority Data

Dec. 24, 2007 (EP) ..... 07255047

(51) Int. Cl.

| | |
|---|---|
| ***C01F 11/20*** | (2006.01) |
| ***C01D 3/00*** | (2006.01) |
| ***C01D 7/00*** | (2006.01) |
| ***C22B 21/06*** | (2006.01) |

(52) U.S. Cl.
USPC ..... 75/308; 75/685

(58) Field of Classification Search
USPC ..... 75/308, 685
See application file for complete search history.

(56) References Cited

U.S. PATENT DOCUMENTS

| | | | | |
|---|---|---|---|---|
| 3,466,170 | A | 9/1969 | Dunkel et al. | |
| 3,986,923 | A * | 10/1976 | Reeve | 162/17 |
| 4,186,248 | A * | 1/1980 | Mellors | 429/321 |

FOREIGN PATENT DOCUMENTS

| | | | |
|---|---|---|---|
| CN | 1342210 | A | 3/2002 |
| DE | 26 58 308 | A1 | 6/1978 |
| DE | 29 35 017 | A1 | 3/1981 |
| DE | 197 20 361 | C1 | 6/1998 |
| EP | 0 030 071 | A1 | 6/1981 |
| SU | 1 044 652 | A1 | 9/1983 |
| WO | WO 99/60180 | A1 | 11/1999 |

OTHER PUBLICATIONS

Derwent Acc-No. 1984-151142 for SU 1044652 A by Kalashniko et al published Sep. 30, 1983.*
English Translation of SU 1044652 by Kalashniko et al, published Sep. 30, 1983.*
Amended International Preliminary Report on Patentability; International Application No. PCT/GB2008/004250, filed Dec. 22, 2008 (9 pgs).
Third Office Action, English Translation, Chinese Application No. 200880127186X, Date of Issue Jan. 28, 2013 (7 pgs).

* cited by examiner

*Primary Examiner* — George Wyszomierski
*Assistant Examiner* — Tima M McGuthry Banks
(74) *Attorney, Agent, or Firm* — Nixon & Vanderhye

(57) ABSTRACT

Composition for releasing sodium or strontium or both into molten aluminum or aluminum-based alloy. The composition is formed by fusing a mixture containing at least two salts, at least one of the salts having sodium as a cation and/or at least one of the salts having strontium as a cation, at least one of the salts having carbonate as an anion and at least one of the salts having a halide as an anion. The composition may be employed as a modifying flux for altering the microstructure of aluminum and aluminum alloy.

26 Claims, No Drawings

MODIFYING FLUX FOR MOLTEN ALUMINIUM

This application is the U.S. national phase of International Application No. PCT/GB2008/004250 filed 22 Dec. 2008 which designated the U.S. and claims priority to 07255047.8 filed 24 Dec. 2007, the entire contents of each of which are hereby incorporated by reference.

The present invention relates to a flux for use in the treatment of molten aluminium and aluminium alloys, and more particularly to a modifying flux for increasing the concentration of sodium and/or strontium in aluminium or aluminium alloy.

The composition of the alloy and the casting process is known to affect the microstructure of aluminium alloy castings. The microstructure can also be changed by the addition of small quantities of certain elements which improve castability, mechanical properties and machinability. Changing the chemical composition to alter the microstructure is called modification and is commonly achieved by the addition of sodium or strontium, particularly to aluminium-silicon alloys.

Sodium modifiers are widely used but have a tendency to fade over a period of time, the gradual loss of sodium leading to some inevitable process control problems. Sodium can be added as metallic sodium (usually vacuum sealed in aluminium cans), or via an electrolysis process as described in EP0688881A1 or via the addition of sodium salts. Strontium is less reactive than sodium and is usually added in the form of master alloys (Sr—Al) and has the added advantage of not fading on standing.

Originally, metal treatment agents (fluxes) based on inorganic salt mixtures were traditionally supplied in powder form, however granulated fluxes have become increasingly popular due to their significant environmental and technical advantages.

In the case of sodium modifiers, it is known that sodium carbonate may be added to the melt at the operating temperature (around 750° C.). Sodium is released into the melt but the reaction yield is very low. Yields may be improved by mixing the sodium carbonate with additional components. For example, DE19720361 describes a treatment mixture for aluminium silicon alloys comprising 30-80 wt % sodium carbonate, 30-80 wt % potassium carbonate and/or sodium chloride, 15-30 wt % magnesium or aluminium powder and 1-10 wt % nitrates and/or chlorates of alkaline metals.

Sodium fluoride releases sodium when it reacts with molten aluminium and has been widely employed as a modifying flux. However there are increasing environmental concerns regarding the use of fluorides and so efforts are being made to reduce, or even eliminate, their use.

In the case of strontium addition, a strontium-aluminium master alloy is most commonly used to increase the strontium content of aluminium and its alloys. A small number of fluxes containing inorganic salts of strontium have been reported for aluminium. EP0030071 describes the addition of strontium peroxide wrapped in aluminium foil to produce a strontium-modified aluminium master alloy, whereas SU1044652 describes a modifier comprising 10-15 wt % sodium fluoride, 25-30 wt % sodium cryolite and 15-25 wt % strontium chloride with sodium chloride the remainder. The modifier is prepared by mixing the components and subsequently drying the mixture. In another example, SU0986948 describes a refining flux containing 30-40 wt % sodium chloride, 10-15 wt % sodium cryolite and 10-20 wt % strontium nitrate with potassium chloride the remainder. U.S. Pat. No. 3,466,170 describes a process for modification of aluminium-silicon alloys by adding strontium and/or barium to the melt. The strontium and/or barium may be added in metallic form or in the form of salt mixtures.

It is an object of the present invention to provide an improved flux for aluminium modification by she addition of sodium or strontium.

According to a first aspect of the present invention there is provided a composition for releasing sodium into molten aluminium or aluminium-based alloy, wherein the composition is formed by fusing a mixture comprising at least two salts, at least one of the salts having sodium as a cation, at least one of the salts having carbonate as an anion and at least one of the salts having a halide as an anion.

By 'fused' it will be understood that the composition is prepared by melting together the components of the mixture. After melting, the mixture is allowed to solidify, typically by casting onto a belt cooler to produce either flakes or pastilles of fused material. This may then be crushed to produce a powdered flux or to be processed further to give a granular flux.

The preferred method is to add the flux as either a powder or in granular form.

The melting point of the composition is chosen according to its intended use. The range of working (treatment and pouring) temperatures for aluminium alloys varies between 700 and 800° C. depending on alloy composition, and for some applications may be higher (e.g. for pistons the working temperature of the aluminium alloy will be of the order 820° C.). In certain embodiments, the melting point of the composition is less than 800° C., less than 750° C., or less than 700° C.

In certain embodiments it may be useful to have a composition with a low fluoride content. The fluoride content of the composition is preferably no greater than 20 wt %, more preferably no greater than 10 wt %, even more preferably no greater than 3 wt % and most preferably no greater than 1 wt %. The composition may be fluoride free.

Preferably, the at least one salt having sodium as a cation is selected from one or more of sodium halide, sodium carbonate ($Na_2CO_3$) and sodium nitrate ($NaNO_3$).

Preferably, the at least one salt having carbonate as an anion is selected from the group I carbonates, more preferably lithium carbonate ($Li_2CO_3$), sodium carbonate ($Na_2CO_3$) or potassium carbonate ($K_2CO_3$) or the group II carbonates.

The halide ion may be a fluoride ion, a chloride ion, a bromide ion or an iodide ion. The halide ion is preferably a chloride ion.

Preferably, the at least one salt having halide as an anion is selected from the group I halides, more preferably sodium halide or potassium halide. The composition may be lithium free.

When the at least one salt having a halide as an anion is a fluoride salt, the fluoride salt is preferably selected from sodium fluoride (NaF), strontium fluoride ($SrF_2$) or a complex compound of the form $X_mMF_n$ where X is an element of the third or fourth period of the periodic table, preferably a group I or group II metal, and M is an element of the third or fourth group of the periodic table, preferably aluminium, titanium or zirconium. Such complex compounds include potassium aluminium fluoride ($KAlF_4$), sodium aluminium fluoride ($NaAlF_4$), potassium fluorotitanate ($K_2TiF_6$) and potassium fluorozirconate ($K_2ZrF_6$).

The composition is preferably fused from a mixture comprising two salts (a binary mixture), three salts (a ternary mixture), or four salts (a quaternary mixture). It will be readily understood that the sodium (or at least part thereof) and one of the required anions may be provided in a single salt.

In one series of embodiments the flux comprises from 5 to 40 wt % sodium, from 10 to 35 wt % sodium, from 12 to 32 wt % sodium, from 15 to 30 wt % sodium, from 20 to 28 wt % sodium or from 22 to 26 wt % sodium.

In another series of embodiments the flux comprises from 5 to 40 wt % potassium, from 8 to 30 wt % potassium, from 12 to 26 wt % potassium, from 17 to 23 wt % potassium or from 19 to 21 wt % potassium.

In a further series of embodiments the flux comprises from 5 to 55 wt % carbonate, from 10 to 50 wt % carbonate, from 20 to 45 wt % carbonate or from 35 to 45 wt % carbonate.

In a yet further series of embodiments the flux comprises from 1 to 35 wt % chloride, from 2 to 25 wt % chloride, from 3 to 20 wt % chloride, from 4 to 15 wt % chloride, or from 4 to 10 wt % chloride.

It will be understood that once the mixture of salts is fused the nature of the starting salts may be indeterminable. Thus for example a composition formed by fusing one mole of sodium chloride (NaCl) and half of a mole of potassium carbonate ($K_2CO_3$) will be equivalent to a composition formed by fusing one mole of potassium chloride (KCl) and a half of a mole of sodium carbonate ($Na_2CO_3$).

Suitable aluminium-based alloys include low silicon alloys (4-6% Si) e.g. BS alloy LM4 (Al—Si5Cu3); medium silicon alloys (7.5-9.5% Si) e.g. BS alloy LM25 (Al—Si7Mg); eutectic alloys (10-13% Si) e.g. BS alloy LM6(Al—Si12); hypereutectic alloys (>16% Si) e.g. BS alloy LM30(Al—Si17Cu4Mg); and aluminium magnesium alloys e.g. BS alloy LM5(Al—Mg5Si; Al—Mg6).

According to a second aspect of the present invention there is provided a composition for releasing strontium into molten aluminium or aluminium-based alloy, wherein the composition is formed by fusing a mixture comprising at least two salts, at least one of the salts having strontium as a cation, at least one of the salts having carbonate as an anion and at least one of the salts having a halide as an anion.

The melting point of the composition is chosen according to its intended use. The range of working (treatment and pouring) temperatures for aluminium alloys varies between 700 and 800° C. depending on alloy composition, and for some applications may be higher (e.g. for pistons the working temperature of the aluminium alloy will be of the order 820° C.). In certain embodiments, the melting point of the composition is less than 800° C., less than 750° C., or less than 700° C.

In certain embodiments it may be useful to have a composition with a low fluoride content. The fluoride content of the composition is preferably no greater than 20 wt %, more preferably no greater than 10 wt %, even more preferably no greater than 3 wt % and most preferably no greater than 1 wt %. The composition may be fluoride free.

Preferably, the at least one salt having strontium as a cation is selected from one or more of strontium halide, strontium carbonate ($SrCO_3$) and strontium nitrate ($Sr(NO_3)_2$).

Preferably, the at least one salt having carbonate as an anion is selected from the group I carbonates, more preferably lithium carbonate ($Li_2CO_3$), sodium carbonate ($Na_2CO_3$) or potassium carbonate ($K_2CO_3$) or the group II carbonates, more preferably strontium carbonate ($SrCO_3$).

The halide ion may be a fluoride ion, a chloride ion, a bromide ion or an iodide ion. The halide ion is preferably a chloride ion.

Preferably, the at least one salt having halide as an anion is selected from the group I halides, more preferably sodium halide or potassium halide or the group II halides, more preferably strontium halide ($SrCl_2$).

When the at least one salt having a halide as an anion is a fluoride salt, the fluoride salt is preferably selected from sodium fluoride (NaF), strontium fluoride ($SrF_2$) or a complex compound of the form $X_mMF_n$ where X is an element of the third or fourth period of the periodic table, preferably a group I or group II metal, and M is an element of the third or fourth group of the periodic table, preferably aluminium, titanium or zirconium. Such complex compounds include potassium aluminium fluoride ($KAlF_4$), sodium aluminium fluoride ($NaAlF_4$), potassium fluorotitanate ($K_2TiF_6$) and potassium fluorozirconate ($K_2ZrF_6$).

The composition is preferably fused from a mixture comprising two salts (a binary mixture), three salts (a ternary mixture), or four salts (a quaternary mixture). It will be readily understood that the strontium (or at least part thereof) and one of the required anions may be provided in a single salt.

A preferred fused composition comprises strontium, carbonate, potassium and chloride.

In one series of embodiments the fused composition comprises from 5 to 50 wt % strontium, from 10 to 40 wt % strontium, from 12 to 30 wt % strontium, from 15 to 25 wt % strontium or from 17 to 21 wt % strontium.

In another series of embodiments the flux comprises from 5 to 45 wt % potassium, from 15 to 40 wt % potassium, from 25 to 37 wt % potassium, or from 30 to 35 wt %.

In a further series of embodiments the flux comprises from 5 to 55 wt % carbonate, from 10 to 50 wt % carbonate, from 20 to 45 wt % carbonate, from 25 to 40 wt % carbonate or from 30 to 35 wt % carbonate.

In a yet further series of embodiments the flux comprises from 1 to 30 wt % chloride, from 2 to 25 wt % chloride, from 3 to 20 wt % chloride, from 4 to 15 wt % chloride, or from 5 to 10 wt % chloride.

It will be understood that once the mixture of salts is fused the nature of the starting salts may be indeterminable. Thus for example a composition formed by fusing one mole of strontium chloride ($SrCl_2$) and one mole of potassium carbonate ($K_2CO_3$) will be equivalent to a composition formed by fusing two moles of potassium chloride (KCl) and one mole of strontium carbonate ($SrCO_3$).

Suitable aluminium-based alloys include low silicon alloys (4-6% Si) e.g. BS alloy LM4 (Al—Si5Cu3); medium silicon alloys (7.5-9.5% Si) e.g. BS alloy LM25 (Al—Si7Mg); eutectic alloys (10-13% Si) e.g. BS alloy LM6 (Al—Si12); hypereutectic alloys (>16% Si) e.g. BS alloy LM30 (Al—Si17Cu4Mg); and aluminium magnesium alloys e.g. BS alloy LM5 (Al—Mg5Si; Al—Mg6).

According to a third aspect of the present invention there is provided a composition for releasing both sodium and strontium into molten aluminium or aluminium-based alloy, wherein the composition is formed by fusing a mixture comprising at least two salts, at least one of the salts having sodium as a cation, at least one of the salts having strontium as a cation, at least one of the salts having carbonate as an anion and at least one of the salts having a halide as an anion.

The melting point of the composition is chosen according to its intended use. The range of working (treatment and pouring) temperatures for aluminium alloys varies between 700 and 800° C. depending on alloy composition, and for some applications may be higher (e.g. for pistons the working temperature of the aluminium alloy will be of the order 820° C.). In certain embodiments, the melting point of the composition is less than 800° C., less than 750° C., or less than 700° C.

In certain embodiments it may be useful to have a composition with a low fluoride content. The fluoride content of the composition is preferably no greater than 20 wt %, more preferably no greater than 10 wt %, even more preferably no greater than 3 wt % and most preferably no greater than 1 wt %. The composition may be fluoride free.

Preferably, the at least one salt having sodium as a cation is selected from one or more of sodium halide, sodium carbonate ($Na_2CO_3$) and sodium nitrate ($NaNO_3$).

Preferably, the at least one salt having strontium as a cation is selected from one or more of strontium halide, strontium carbonate ($SrCO_3$) and strontium nitrate ($Sr(NO_3)_2$).

Preferably, the at least one salt having carbonate as an anion is selected from the group I carbonates, more preferably lithium carbonate ($Li_2CO_3$), sodium carbonate ($Na_2CO_3$) or potassium carbonate ($K_2CO_3$) or the group II carbonates, more preferably strontium carbonate ($SrCO_3$).

The halide ion may be a fluoride ion, a chloride ion, a bromide ion or an iodide ion. The halide ion is preferably a chloride ion.

Preferably, the at least one salt having halide as an anion is selected from the group I halides, more preferably sodium halide or potassium halide, or the group II halides, more preferably strontium halide.

When the at least one salt having a halide as an anion is a fluoride salt, the fluoride salt is preferably selected from sodium fluoride (NaF), strontium fluoride ($SrF_2$) or a complex compound of the form $X_mMF_n$ where X is an element of the third or fourth period of the periodic table, preferably a group I or group II metal, and M is an element of the third or fourth group of the periodic table, preferably aluminium, titanium or zirconium. Such complex compounds include potassium aluminium fluoride ($KAlF_4$), sodium aluminium fluoride ($NaAlF_4$), potassium fluorotitanate ($K_2TiF_6$) and potassium fluorozirconate ($K_2ZrF_6$).

The composition is preferably fused from a mixture comprising two salts (a binary mixture), three salts (a ternary mixture), or four salts (a quaternary mixture). It will be readily understood that the sodium (or at least part thereof) and one of the required anions may be provided in a single salt and that the strontium (or at least part thereof) and one of the required anions may be also be provided in a single salt.

It will be understood that once the mixture of salts is fused the nature of the starting salts may be indeterminable.

A preferred fused flux comprises sodium, strontium, carbonate, potassium and chloride.

In one series of embodiments the fused composition comprises from 1 to 40 wt strontium, from 5 to 30 wt % strontium, from 10 to 30 wt % strontium, or from 14 to 20 wt % strontium.

In another series of embodiments the flux comprises from 1 to 40 wt % sodium, from 2 to 30 wt % sodium, from 3 to 20 wt % sodium, or from 5 to 10 wt % sodium.

In a further series of embodiments the flux comprises from 5 to 45 wt % potassium, from 15 to 40 wt % potassium, from 25 to 37 wt % potassium, or from 30 to 35 wt %.

In a yet further series of embodiments the flux comprises from 5 to 55 wt % carbonate, from 10 to 50 wt carbonate, from 20 to 45 wt % carbonate, from 25 to 40 wt % carbonate or from 30 to 35 wt % carbonate In a yet further series of embodiments the flux comprises from 1 to 30 wt % chloride, from 2 to 25 wt % chloride, from 3 to 20 wt % chloride, from 5 to 15 wt % chloride, from 7 to 12 wt % chloride.

Suitable aluminium-based alloys include low silicon alloys (4-6% Si) e.g. BS alloy LM4 (Al—Si5Cu3); medium silicon alloys (7.5-9.5% Si) e.g. BS alloy LM25 (Al—Si7Mg); eutectic alloys (10-13% Si) e.g. BS alloy LM6(Al—Si12); hypereutectic alloys (>16% Si) e.g. BS alloy LM30(Al—Si17Cu4Mg); and aluminium magnesium alloys e.g. BS alloy LM5(Al—Mg5Si; Al—Mg6).

In a fourth aspect of the present invention, there is provided a method for releasing sodium and/or strontium into molten aluminium or aluminium-based alloy, comprising adding the composition of any one of the first, second or third aspects to molten aluminum or aluminium-based alloy.

Suitable aluminium alloys include low silicon alloys (4-6% Si) e.g. BS alloy LM4 (Al—Si5Cu3); medium silicon alloys (7.5-9.5% Si) e.g. BS alloy LM25 (Al—Si7Mg); eutectic alloys (10-13% Si) e.g. BS alloy LM6 (Al—Si12); hypereutectic alloys (>16% Si) e.g. BS alloy LM30 (Al—Si17Cu4Mg); and aluminium magnesium alloys e.g. BS alloy LM5 (Al—Mg5Si; Al—Mg6).

Embodiments of the invention will now be described by way of example only.

Methodology

The fused compositions (fluxes) were prepared by melting together mixtures of the components in the relevant proportions, casting the molten material into ingots and then crushing the ingots into particles of a maximum size of 5 mm. The particles were then added to an aluminium alloy having 7% silicon and 0.3% magnesium at a temperature of between 700 and 800° C. The sodium and/or strontium content of the alloy was measured using spark emission spectrometry before and at a fixed time after addition using SPECTROMAX (Spectro) equipment. This method employs a simultaneously measuring optical emission-spectrograph with argon flushed spark area for quantitative analysis of metallic samples. The samples are taken from the melt and poured into a die. After solidification the sample is taken from the die and the front face of the sample is machined on a lathe and finally ground. The machined sample is positioned on the sample holder of the spectrograph device and analysed automatically for the major alloying elements. This analysis is repeated 3 times and the average value is taken as the final measurement.

Sodium and/or strontium release is shown as parts per million in the melt (ppm) and as an efficiency value. The sodium/strontium efficiency is the % mass of sodium/strontium measured in the melt as compared to the mass of sodium/strontium that would be measured if all of the sodium/strontium added to the melt (in the form of flux) remained. The flux yield (data not shown) is a useful measure that is sometimes used in the industry. It is the amount of sodium/strontium released into the metal (ppm), divided by the weight of the flux relative to the weight of the metal expressed as a percentage. Flux yield is expressed as ppm/%. All percentages are by weight.

Trials were carried out on 3 kg, 100 kg or 350 kg melts.

For the small 3 kg melt trials, the flux was added to the molten aluminium alloy as it was being mechanically stirred in a small crucible. Samples were taken immediately before and 1 minute after treatment.

For the larger trials (100 kg and 350 kg melts) the material was added via a Metal Treatment Station as sold by Foseco under the trade name MTS 1500. Using a 140 mm diameter rotor (as sold under the Foseco trade name "FDR") at a rotation speed of 310 rpm a sample ("initial") was taken to determine the concentration of sodium and or strontium in the melt prior to treatment. The rotation speed was then increased to 560 rpm to form a vortex in the melt. The flux was then added and mixing continued for a short period (either 1 or 2 minutes) to ensure thorough dispersion throughout the melt and a second sample taken ("1 minute" or "2 minute" treatment sample). For some trials, additional samples were taken after further mixing so as to assess the rate of modification by the fluxes and or the fading of the modified melt. For these examples, mixing was continued at the rotor speed of 310 rpm and the aluminium melt degassed using dry nitrogen at a flow rate of 10 liters per minute. A third sample ("5 minute sample") was then taken after the additional (4 or 3 minutes) mixing.

1. SODIUM ADDITION

Example 1

$Na_2CO_3$ and KCl form a binary eutectic comprising 52% $Na_2CO_3$ and 48% KCl that has a melting point of 588° C. A mixture comprising 52% $Na_2CO_3$ and 48% KCl was fused (melted), then cast and crushed into particles of a size smaller than 5 mm. Three batches of the fused composition thus obtained were each added to 100 kg of an aluminium alloy. The Na content of the alloy was measured 1 minute after treatment as shown in table 1 below.

COMPARATIVE EXAMPLE 1

1000 g of a mixture comprising 52% $Na_2CO_3$ and 48% KCl was added to 100 kg of an aluminium alloy of the same composition as in Example 1 without pre-melting. The Na content of the alloy was measured as shown in table 1 below.

TABLE 1

| | Weight of Alloy (kg) | Quantity of Flux Added (kg) | Initial Na Content (ppm) | Final Na Content (ppm) | Na Efficiency (%) |
|---|---|---|---|---|---|
| Ex 1a | 100 | 0.750 | 0 | 40 | 2.4 |
| Ex 1b | 100 | 0.715 | 0 | 60 | 3.7 |
| Ex 1c | 100 | 1.000 | 0 | 30 | 1.3 |
| Comp Ex 1 | 100 | 1.000 | 0 | 10 | 0.4 |

As can be seen from the table above, a greater increase in Na content was achieved when the mixture of $Na_2CO_3$ and KCl was fused (melted) to form a fused composition before addition to the aluminium alloy (Ex 1) than when a mixture of $Na_2CO_3$ and KCl was added without pre-melting i.e. as a granulated mixture of dry blended powders (Comp Ex 1).

Example 2

A fused composition (flux) was prepared from a mixture of 36% $Na_2CO_3$, 34% KCl and 30% $MgCO_3$. $Na_2CO_3$ and KCl were melted (fused) together and then $MgCO_3$ was added. The fused mixture was then cast and crushed as described previously. Three 6 g batches of the fused flux were each added to 3 kg of aluminium alloy. The sodium content is shown in table 2 below.

COMPARATIVE EXAMPLE 2

A granulated mixture comprising 36% $Na_2CO_3$, 34% KCl and 30% $MgCO_3$ was prepared. Three 6 g batches were each added to 3 kg of aluminium alloy without pre-melting. The sodium content is shown in the table below.

TABLE 2

| | Initial Na Content (ppm) | Final Na Content (ppm) | Na Efficiency (%) |
|---|---|---|---|
| Ex 2a | 0 | 30 | 9.6 |
| Ex 2b | 0 | 30 | 9.6 |
| Ex 2c | 0 | 20 | 6.4 |
| Comp Ex 2a | 0 | 0 | 0 |
| Comp Ex 2b | 0 | 0 | 0 |
| Comp. Ex 2c | 0 | 0 | 0 |

Examples 2a to 2c each release sodium into the melt whereas none of the comparative examples release sodium. This indicates that pre-melting the components is beneficial for sodium release.

Example 3

Particles of a fused flux having a melting point of 600° C. were prepared from the mixture shown in the table below. 30 g of the fused flux was added to 3 kg of aluminium alloy causing the Na content of the alloy to increase from 0 ppm to 80 ppm as shown in the table below.

TABLE 3

| | Starting materials | Initial Na Content (ppm) | Final Na Content (ppm) | Na Efficiency (%) |
|---|---|---|---|---|
| Ex 3 | 24.7% $Na_2CO_3$ + 34.5% NaCl + 40.8% $K_2CO_3$ | 0 | 80 | 3.3 |

The fused flux of Ex 3 is substantially equivalent to the fused flux of Ex 1 despite being prepared from different starting materials. The fused fluxes of Ex 1 and Ex 3 both release sodium into the melt at a significantly higher level than the unfused equivalent.

Examples 4 to 8

Fused Fluxes Prepared from Ternary Mixtures Comprising $Na_2CO_3$ and KCl

Fused compositions (fluxes) were prepared from the ternary mixtures described below and added to an aluminium alloy in the quantities indicated. The sodium content was measured at 1 minute (1'), at 2 minutes (2') or at 5 minutes (5') after addition of the fused composition (flux) to the alloy.

TABLE 4

| | Starting mixture | Flux Preparation Temperature (° C.) | Weight of alloy (kg) | Quantity of Fused Flux Added (kg) | Initial Na Content (ppm) | Final Na Content (ppm) | Na Efficiency (%) |
|---|---|---|---|---|---|---|---|
| Ex 4 | 47% $Na_2CO_3$ + 43% KCl + 10% $NaNO_3$ | 650 | 100 | 1.000 | 0 | 50 (1')<br>40 (5') | 2.2 (1')<br>1.7 (5') |
| Ex 5 | 37% $Na_2CO_3$ + 35% KCl + 28% NaCl | 650 | 100 | 1.000 | 0 | 60 (1')<br>20 (5') | 2.2 (1')<br>0.7 (5') |
| Ex 6a | 49.4% $Na_2CO_3$ + 45.6% KCl + 5% $KAlF_4$ | 650 | 100 | 1.000 | 0 | 90 (2')<br>80 (5') | 4.2 (2')<br>3.8 (5') |
| Ex 6b | Same as Ex 6a | 650 | 100 | 0.500 | 0 | 50 (1')<br>50 (5') | 4.7 (1')<br>4.7 (5') |
| Ex 7 | 63.6% $Na_2CO_3$ + 31.4% KCl + 5% $KAlF_4$ | 700 | 350 | 0.800 | 18 | 119 (1') | 16 (1') |
| Ex 8 | 71.4% $Na_2CO_3$ + 23.6% KCl + 5% $KAlF_4$ | 700 | 350 | 0.800 | 22 | 141 (1') | 16.8 (1') |

It can be seen that all of the fluxes released sodium into the aluminium alloy. Ex 6a, 6b, 7 and 8 all relate to fused fluxes prepared from 5% $KAlF_4$ and varying ratios of $Na_2CO_3$ and KCl.

Ex 6a and Ex 6b relate to the same fused flux comprising 49.4% $Na_2CO_3$, 45.6% KCl and 5% $KAlF_4$. 1.0 kg was added to 100 kg of alloy for Ex 6a and 0.5 kg was added to 100 kg of alloy for Ex 6b. It can be seen that Ex 6a resulted in a greater absolute increase in sodium content (approximately twice as much) as compared to Ex 6b as would be expected, the efficiency being similar in both cases. Ex 4, 5 and 6a all show some degree of fade (loss of sodium) accelerated by the extended mixing of the modified melt.

Examples 9 to 11

Fused Fluxes Prepared from Binary and Ternary Mixtures Comprising $Na_2CO_3$ and NaCl Fused fluxes were prepared from the binary and ternary mixtures described below and added to an aluminium alloy in the quantities indicated. The sodium content was measured at 1 minute (1'), at 2 minutes (2') or at 5 minutes (5') after addition of the fused composition to the alloy.

TABLE 5

| | Starting mixture | Flux Preparation Temperature (° C.) | Weight of Alloy (kg) | Quantity of Fused Flux Added (kg) | Initial Na Content (ppm) | Final Na Content (ppm) | Na Efficiency (%) |
|---|---|---|---|---|---|---|---|
| Ex 9 | 57% $Na_2CO_3$ + 43% NaCl | 700 | 100 | 1.000 | 0 | 90 (1')<br>20 (5') | 2.2 (1')<br>0.5 (5') |
| Ex 10a | 54.1% $Na_2CO_3$ + 40.9% NaCl + 5% $KAlF_4$ | 780 | 100 | 1.000 | 0 | 80 (2')<br>70 (5') | 2.0 (2')<br>1.8 (5') |
| Ex 10b | Same as Ex 10a | 780 | 350 | 0.715 | 23 | 87 (1') | 7.9 (1') |
| Ex 11 | 68.4% $Na_2CO_3$ + 26.6% NaCl + 5% $KAlF_4$ | Approx 725 | 350 | 0.800 | 30 | 125 (1') | 10.4 (1') |

All of the fused compositions (fluxes) released sodium on addition to the alloy. This indicates that a fused composition (flux) prepared from a mixture comprising $Na_2CO_3$ and NaCl and optionally another salt such as KCl or $KAlF_4$ would be useful for sodium addition. Ex 9 and 10b further demonstrates the feature of sodium fading on extended mixing of the melt.

Examples 12 to 17

Fused Fluxes Prepared from Quaternary Mixtures Comprising $Na_2CO_3$

Fused fluxes were prepared from the quaternary mixtures described below and added to an aluminium alloy in the quantities indicated. The sodium content was measured at 1 minute (1'), at 2 minutes (2') or at 5 minutes (5') after addition of the fused composition to the alloy.

TABLE 6

| | Starting mixture | Flux Preparation Temperature (° C.) | Weight of Alloy (kg) | Quantity of Fused Flux Added (kg) | Initial Na Content (ppm) | Final Na Content (ppm) | Na Efficiency (%) |
|---|---|---|---|---|---|---|---|
| Ex 12 | 33% $Na_2CO_3$ + 32% KCl + 25% NaCl + 10% $NaNO_3$ | 780 | 100 | 1.000 | 0 | 90 (2')<br>40 (5') | 3.4 (2')<br>1.5 (5') |
| Ex 13 | 35.2% $Na_2CO_3$ + 33.2% KCl + 26.6% NaCl + 5% $NaNO_3$ | 780 | 350 | 0.400 | 15 | 31 (1') | 5.2 (1') |
| Ex 14 | 35.2% $Na_2CO_3$ + 33.2% KCl + 26.6% NaCl + 5% $KAlF_4$ | 780 | 350 | 0.800 | 17 | 123 (1') | 18.1 (1') |
| Ex 15 | 56.0% $Na_2CO_3$ + 19.7% KCl + 19.3% $K_2CO_3$ + 5% $KAlF_4$ | 700 | 350 | 0.800 | 17 | 160 (1') | 25.8 (1') |
| Ex 16 | 59.8% $Na_2CO_3$ + 10.4% KCl + 24.8% K2$CO_3$ + 5% $KAlF_4$ | 725 | 350 | 0.800 | 37 | 316 (1') | 47.1 (1') |
| Ex 17 | 59.0% $Na_2CO_3$ + 18.0% KCl + 18.0% NaCl + 5% $KAlF_4$ | 700 | 350 | 0.800 | 33 | 144 (1') | 14.9 (1') |

All of the fluxes release a significant amount of sodium into the melt with Ex 15 and Ex 16 being particularly efficient.

Example 18

A fused flux was prepared from 53.0% $Na_2CO_3$, 18.7% KCl, 18.3% $K_2CO_3$, 5% $KAlF_4$ and 5% $NaNO_3$ and added to an aluminium alloy in the quantities indicated.

TABLE 7

| | Flux Preparation Temperature (° C.) | Weight of Alloy (kg) | Quantity of Fused Flux Added (kg) | Initial Na Content (ppm) | Final Na Content (ppm) | Na Efficiency (%) |
|---|---|---|---|---|---|---|
| Ex 18 | 725 | 350 | 0.800 | 27 | 174 (1') | 26.5 (1') |

Example 19

Fused Composition Prepared from $Na_2CO_3$ and $K_2CO_3$

A fused composition was prepared from the mixture shown below. 400 g of the fused composition was added to 100 kg of aluminium alloy and the sodium content measured 2 and 5 minutes after addition.

TABLE 8

| | Starting mixture | Flux Preparation Temperature (° C.) | Weight of Alloy (kg) | Quantity of Fused Flux Added (kg) | Initial Na Content (ppm) | Final Na Content (ppm) | Na Efficiency (%) |
|---|---|---|---|---|---|---|---|
| Ex 19 | 65.2% $Na_2CO_3$ + 29.8% $K_2CO_3$ + 5% $KAlF_4$ | 750 | 100 | 0.400 | 0 | 71 (2')<br>80 (5') | 6.3 (2')<br>7.1 (5') |

It was noted that there was a small amount of slurry-like dross residue remaining in the molten metal crucible after treatment Examples 20 and 21

Fused Fluxes Prepared from $Na_2CO_3$ and a Group I Bromide

TABLE 9

| | Starting mixture | Flux Preparation Temperature (° C.) | Weight of Alloy (kg) | Quantity of Fused Flux Added (kg) | Initial Na Content (ppm) | Final Na Content (ppm) | Na Efficiency (%) |
|---|---|---|---|---|---|---|---|
| Ex 20 | 57% $Na_2CO_3$ + 43% NaBr | 750 | 3 | 0.030 | 0 | 150 (1') | 4.4 (1') |
| Ex 21 | 52% $Na_2CO_3$ + 48% KBr | 750 | 3 | 0.030 | 0 | 50 (1') | 2.2 (1') |

Examples 22 and 23

Fused Fluxes Prepared from $Na_2CO_3$ and a Group I Iodide

TABLE 10

| | Starting mixture | Flux Preparation Temperature (° C.) | Weight of Alloy (kg) | Quantity of Fused Flux Added (kg) | Initial Na Content (ppm) | Final Na Content (ppm) | Na Efficiency (%) |
|---|---|---|---|---|---|---|---|
| Ex 22 | 57% $Na_2CO_3$ + 43% NaI | 800 | 3 | 0.030 | 0 | 70 (1') | 23 (1') |
| Ex 23 | 52% $Na_2CO_3$ + 48% KI | 800 | 3 | 0.030 | 0 | 150 (1') | 6.7 (1') |

2. STRONTIUM ADDITION

Examples 24 to 29

Fused Fluxes Prepared from $SrCO_3$, KCl, $K_2CO_3$ and $K_2TiF_6$

Fused compositions were prepared from the mixtures described below and added to an aluminium alloy in the quantities indicated. The strontium content was measured at 1 minute (1'), at 2 minutes (2') or at 5 minutes (5') after addition of the fused composition to the alloy.

TABLE 11

| | Starting mixture | Flux Preparation Temperature (° C.) | Weight of Alloy (kg) | Quantity of Fused Flux Added (kg) | Initial Sr Content (ppm) | Final Sr Content (ppm) | Sr Efficiency (%) |
|---|---|---|---|---|---|---|---|
| Ex 24a | 32.5% $SrCO_3$ + 22.9% KCl + 42.1% $K_2CO_3$ + 2.5% $K_2TiF_6$ | 800 | 3 | 0.060 | 0 | 30 (1') | 0.8 (1') |
| Ex 24b | Same as Ex 24a | 800 | 100 | 0.400 | 0 | 5 (2')<br>6 (5') | 0.6 (1')<br>0.7 (1') |
| Ex 25a | 27.9% $SrCO_3$ + 10.2% KCl + 59.4% $K_2CO_3$ + 2.5% $K_2TiF_6$ | 790 | 3 | 0.060 | 0 | 8 (1') | 0.2 (1') |
| Ex 25b | Same as Ex 25a | 790 | 100 | 0.400 | 0 | 0 (2')<br>1 (5') | 0.0 (1')<br>0.2 (1') |
| Ex 26a | 43.3% $SrCO_3$ + 13.5% KCl + 40.7% $K_2CO_3$ + 2.5% $K_2TiF_6$ | 820 | 3 | 0.060 | 0 | 10 (1') | 0.2 (1') |
| Ex 26b | Same as Ex 26a | 820 | 100 | 0.400 | 0 | 6 (2')<br>5 (5') | 0.6 (2')<br>0.5 (5') |

TABLE 11-continued

| | Starting mixture | Flux Preparation Temperature (° C.) | Weight of Alloy (kg) | Quantity of Fused Flux Added (kg) | Initial Sr Content (ppm) | Final Sr Content (ppm) | Sr Efficiency (%) |
|---|---|---|---|---|---|---|---|
| Ex 27a | 30.4% $SrCO_3$ + 15.0% KCl + 52.1% $K_2CO_3$ + 2.5% K2$TiF_6$ | 800 | 3 | 0.060 | 0 | 11 (1') | 0.3 (1') |
| Ex 27b | Same as Ex 27a | 800 | 3 | 0.060 | 0 | 5 (1') | 1.4 (1') |
| Ex 27c | Same as Ex 27a | 800 | 100 | 0.400 | 0 | 2 (2')<br>2 (5') | 0.3 (2')<br>0.3 (5') |
| Ex 28a | 30.4% $SrCO_3$ + 10.0% KCl + 57.1% $K_2CO_3$ + 2.5% $K_2TiF_6$ | 800 | 3 | 0.060 | 0 | 6 (1') | 0.2 (1') |
| Ex 28b | Same as Ex 28a | 800 | 100 | 0.200 | 0 | 2 (2')<br>2 (5') | 0.6 (2')<br>0.6 (5') |
| Ex 29 | 30.4% $SrCO_3$ + 20.0% KCl + 47.1% $K_2CO_3$ + 2.5% K2$TiF_6$" | 800 | 3 | 0.060 | 0 | 9 (1') | 0.3 (1') |

Examples 30 and 31

Fused Fluxes Prepared from $SrCO_3$, KCl, $K_2CO_3$, $SrCl_2$ and $K_2TiF_6$ Fused fluxes were prepared from the mixtures described below and added to an aluminium alloy in the quantities indicated. The strontium content was measured at 1 minute (1'), at 2 minutes (2') or at 5 minutes (5') after addition of the fused composition to the alloy.

TABLE 12

| | Starting mixture | Flux Preparation Temperature (° C.) | Weight of Alloy (kg) | Quantity of Fused Flux Added (kg) | Initial Sr Content (ppm) | Final Sr Content (ppm) | Sr Efficiency (%) |
|---|---|---|---|---|---|---|---|
| Ex 30a | 20.2% $SrCO_3$ + 8.3% KCl + 13.1% $SrCl_2$ + 53.4% $K_2CO_3$ + 5% $K_2TiF_6$ | 800 | 3 | 0.060 | 0 | 10 (1') | 0.3 (1') |
| Ex 30b | Same as Ex 30a | 800 | 3 | 0.060 | 0 | 31 (1') | 0.8 (1') |
| Ex 30c | Same as Ex 30a | 800 | 100 | 0.400 | 0 | 5 (2')<br>5 (5') | 0.7 (2')<br>0.7 (5') |
| Ex 31a | 20.2% $SrCO_3$ + 10.8% KCl + 13.1% $SrCl_2$ + 53.4% $K_2CO_3$ + 2.5% $K_2TiF_6$ | 800 | 3 | 0.060 | 0 | 39-90 (1') | 1.0-2.3 |
| Ex 31b | Same as Ex 31a | 800 | 100 | 0.400 | 0 | 5 (2')<br>6 (5') | 0.7 (2')<br>0.8 (5') |

Example 32

Fused Fluxes Prepared from $SrCO_3$, KCl, $K_2CO_3$, $SrCl_2$ and $KAlF_4$

Fused fluxes were prepared from a mixture comprising 20.2% $SrCO_3$, 8.3% KCl, 13.1% $SrCl_2$, 53.4% $K_2CO_3$ and 5% $KAlF_4$ and added to an aluminium alloy in the quantities indicated below. The strontium content was measured at 1 minute (1'), at 2 minutes (2') or at 5 minutes (5') after addition of the fused composition to the alloy.

TABLE 13

| | Flux Preparation Temperature (° C.) | Weight of Alloy (kg) | Quantity of Fused Flux Added (kg) | Initial Sr Content (ppm) | Final Sr Content (ppm) | Sr Efficiency (%) |
|---|---|---|---|---|---|---|
| Ex 32a | 800 | 3 | 0.030 | 0 | 10 (1') | 0.5 (1') |
| Ex 32b | 800 | 3 | 0.060 | 0 | 40 (1') | 1.1 (1') |
| Ex 32c | 800 | 3 | 0.060 | 0 | 90 (1') | 2.4 (1') |
| Ex 32d | 800 | 3 | 0.060 | 0 | 40 (1') | 1.1 (1') |
| Ex 32e | 800 | 3 | 0.060 | 0 | 40 (1') | 1.1 (1') |
| Ex 32f | 800 | 100 | 0.400 | 0 | 5 (2') | 0.7 (2') |
| | | | | | 5 (5') | 0.7 (5') |

Ex 32a, 32b and 32f were prepared by melting all of the components together and it was noted that the $KAlF_4$ bubbled vigorously on melting at the high preparation temperature required to melt the mix. Ex 32c, Ex 32d and Ex 32e were prepared by first melting $SrCl_2$, KCl and $K_2CO_3$ and then adding $SrCO_3$ and $KAlF_4$ together (Ex 32c), adding $SrCO_3$ followed by $KAlF_4$ (Ex 32d) or adding $KAlF_4$ followed by $SrCO_3$ (Ex 32e). It was further noted that the composition tended to be hygroscopic, irrespective of the method of preparation.

Example 33

Fused Composition (Flux) Prepared from $SrCO_3$, LiCl, $Li_2CO_3$, $Na_2CO_3$ and $KAlF_4$ A fused flux was prepared from a mixture comprising 61.8.% $SrCO_3$, 1.8% LiCl, 9.3% $Li_2CO_3$, 22.1% $Na_2CO_3$ and 5% $KAlF_4$. 30 g of the flux was added to 3 kg aluminium alloy and the strontium content measured 1 minute after addition.

TABLE 14

| | Flux Preparation Temperature (° C.) | Weight of Alloy (kg) | Quantity of Fused Flux Added (kg) | Initial Sr Content (ppm) | Final Sr Content (ppm) | Sr Efficiency (%) |
|---|---|---|---|---|---|---|
| Ex 33 | 800 | 3 | 0.030 | 0 | 10 (1') | 0.3 (1') |

Example 34

Fused Composition (Flux) Prepared from $SrCO_3$, $CaCl_2$, $K_2CO_3$ and $K_2TiF_6$ A fused flux was prepared from a mixture comprising 30.4% $SrCO_3$, 15.0% $CaCl_2$, 52.1% $K_2CO_3$ and 2.5% $K_2TiF_6$. 60 g of the flux was added to 3 kg aluminium alloy and the strontium content measured 1 minute after addition.

TABLE 15

| | Flux Preparation Temperature (° C.) | Weight of Alloy (kg) | Quantity of Fused Flux Added (kg) | Initial Sr Content (ppm) | Final Sr Content (ppm) | Sr Efficiency (%) |
|---|---|---|---|---|---|---|
| Ex 34 | 800 | 3 | 0.060 | 0 | 9 (1') | 0.3 (1') |

3. COMBINED SODIUM AND STRONTIUM ADDITION

Examples 35, 36 and 37

Fused Fluxes Prepared from $SrCO_3$, NaCl, $K_2CO_3$ and $K_2TiF_6$

Fused fluxes were prepared from the mixtures described below and added to aluminium alloy in the quantities indicated.

TABLE 16

| | | Weight of Alloy (kg) | Quantity of Fused Flux Added (kg) | Flux Preparation Temperature (° C.) | Initial Content (ppm) Na | Initial Content (ppm) Sr | Final Content (ppm) Na | Final Content (ppm) Sr | Efficiency (%) Na | Efficiency (%) Sr |
|---|---|---|---|---|---|---|---|---|---|---|
| Ex 35 | 24.6% $SrCO_3$ + 19.5% NaCl + 53.4% $K_2CO_3$ + 2.5% $K_2TiF_6$ | 3 | 0.030 | 620-740 | 0 | 0 | 24 | 13 | 1.6 | 0.5 |
| Ex 36 | 26.9% $SrCO_3$ + 17.2% NaCl + 53.4% $K_2CO_3$ + 2.5% $K_2TiF_6$ | 3 | 0.030 | 620-740 | 0 | 0 | 22 | 7 | 1.67 | 0.2 |
| Ex 37a | 30.4% $SrCO_3$ + 15.0% NaCl + 52.1% $K_2CO_3$ + 2.5% $K_2TiF_6$ | 3 | 0.030 | 800 | 0 | 0 | 23 | 19 | 1.9 | 0.5 |
| Ex 37b | Same as Ex 37a | 100 | 0.400 | 800 | 0 | 0 | 14.0 (5') | 2 (2')<br>4 (5') | 11.9 (5') | 0.3 (2')<br>0.6 (5') |

Ex 35 and 36 were prepared by first melting NaCl, $K_2TiF_6$ and two thirds of the amount of $K_2CO_3$ together at 620° C. The temperature was then raised to 740° C., and $SrCO_3$ added together with the remainder (one third) of the $K_2CO_3$. All of the fluxes release both Na and Sr into the melt.

Examples 38 and 39

Fused Fluxes Prepared from $SrCO_3$, $Na_2CO_3$, NaF and KF

Fused fluxes were prepared from the mixtures described below and added to aluminium alloy in the quantities indicated.

TABLE 17

| | | Weight of Alloy (kg) | Quantity of Fused Flux Added (kg) | Initial Content (ppm) Na | Initial Content (ppm) Sr | Final Content (ppm) Na | Final Content (ppm) Sr | Efficiency (%) Na | Efficiency (%) Sr |
|---|---|---|---|---|---|---|---|---|---|
| Ex 38 | 56.8% $SrCO_3$ + 0.6% NaF + 12.2% $Na_2CO_3$ + 30.4% KF | 3 | 0.060 | 0 | 3 | 5 | 19 | 0.5 | 0.3 |
| Ex 39 | 67.1% $SrCO_3$ + 5.1% NaF + 4.0% $Na_2CO_3$ + 23.8% KF | 3 | 0.060 | 0 | 1 | 22 | 23 | 2.5 | 0.3 |

Examples 40, 41, 42 and 43

Fused Fluxes Prepared from Quaternary Mixtures Comprising $Na_2CO_3$, $SrCO_3$, and $K_2CO_3$ Fused fluxes were prepared from the mixtures described below and added to aluminium alloy in the quantities indicated.

TABLE 18

| | | Weight of Alloy | Quantity of Fused Flux Added | Flux Preparation Temperature | Initial Content (ppm) | | Final Content (ppm) | | Efficiency (%) | |
|---|---|---|---|---|---|---|---|---|---|---|
| | | (kg) | (kg) | (° C.) | Na | Sr | Na | Sr | Na | Sr |
| Ex 40 | 44.8% $SrCO_3$ + 26.2% $K_2CO_3$ + 20.1% $Na_2CO_3$ + 8.9% NaCl | 100 | 0.400 | 800 | 0 | 5 | 88 (2')<br>67 (5') | 23 (2')<br>26 (5') | 18.1 (2')<br>13.8 (5') | 2.2 (2')<br>2.5 (5') |
| Ex 41 | 49.3% $SrCO_3$ + 18.0% $K_2CO_3$ + 21.6% $Na_2CO_3$ + 11.1% KCl | 100 | 0.400 | 800 | 0 | 4 | 52 (2')<br>43 (5') | 16 (2')<br>18 (5') | 13.9 (2')<br>11.5 (5') | 1.4 (2')<br>1.5 (5') |
| Ex 42 | 5.8% $SrCO_3$ + 43.2% $K_2CO_3$ + 16.6% $Na_2CO_3$ + 34.4% $SrF_2$ | 3 | 0.060 | 750-800 | 0 | 2 | 7 | 24 | 0.5 | 0.4 |
| Ex 43 | 46.2% $SrCO_3$ + 5.4% $K_2CO_3$ + 16.6% $Na_2CO_3$ + 31.8% KF | 3 | 0.060 | 800 | 0 | 2 | 10 | 27 | 0.7 | 0.5 |

The invention claimed is:

1. A solid composition for releasing strontium into molten aluminium or aluminium-based alloy, wherein the composition is formed by fusing a mixture comprising at least two salts, each salt comprising a cation and an anion, at least one of the salts having strontium as the cation, at least one of the salts having carbonate as the anion and at least one of the salts having chloride as the anion.

2. The composition according to claim 1, having a melting point that is less than 800° C.

3. The composition according to claim 1, wherein the at least one salt having carbonate as an anion is selected from the group consisting of group I carbonates and group II carbonates.

4. The composition according to claim 1, wherein the at least one salt having carbonate as an anion is selected from the group consisting of sodium carbonate, potassium carbonate and strontium carbonate.

5. The composition according to claim 1, wherein the at least one salt having chloride as an anion is selected from the group consisting of sodium chloride, potassium chloride and strontium chloride.

6. The composition according to claim 1 that is fluoride free.

7. The composition according to claim 1, wherein the at least one salt having chloride as an anion is a group I chloride salt.

8. A solid composition for releasing sodium into molten aluminium or aluminium-based alloy, wherein the composition is formed by fusing a mixture comprising at least two salts, each salt comprising a cation and an anion, at least one of the salts having sodium as the cation, at least one of the salts having carbonate as the anion and at least one of the salts having a halide as the anion, wherein the composition comprises from 5 to 40% sodium.

9. The composition according to claim 8, wherein the at least one salt having sodium as a cation is selected from the group consisting of sodium halide, sodium carbonate ($Na_2CO_3$) and sodium nitrate ($NaNO_3$).

10. The composition according to claim 8, wherein the at least one salt having carbonate as an anion is selected from the group consisting of group I carbonates and group II carbonates.

11. The composition according to claim 8, wherein the at least one salt having carbonate as an anion is selected from the group consisting of sodium carbonate, potassium carbonate and strontium carbonate.

12. The composition according to claim 8, wherein the at least one salt having halide as an anion is selected from group I halides.

13. The composition according to claim 8, wherein the at least one salt having halide as an anion is selected from the group consisting of sodium halide, potassium halide and strontium halide.

14. The composition according to claim 8, wherein the at least one salt having a halide as an anion is a chloride salt.

15. The composition according to claim 8, wherein the at least one salt having halide as an anion is selected from the group consisting of sodium chloride, potassium chloride and strontium chloride.

16. The composition according to claim 8, wherein the at least one salt having halide an anion is selected from the group consisting of sodium fluoride (NaF), potassium fluoride (KF), strontium fluoride ($SrF_2$) potassium aluminium fluoride ($KAlF_4$), sodium aluminium fluoride ($NaAlF_4$), potassium fluorotitanate ($K_2TiF_6$) and potassium fluorozirconate ($K_2ZrF_6$).

17. The composition according to claim 8 that is fluoride free.

18. A method for releasing sodium into molten aluminium or aluminium-based alloy, comprising adding the composition of claim 8 to molten aluminium or aluminium-based alloy.

19. The composition according to claim 8, having a melting point that is less than 800° C.

20. A solid composition for releasing strontium into molten aluminium or aluminium-based alloy, wherein the composition is formed by fusing a mixture comprising at least two salts, each salt comprising a cation and an anion, at least one of the salts having strontium as the cation, at least one of the salts having carbonate as the anion and at least one of the salts having a halide as the anion, wherein the composition is fluoride-free.

21. The composition according to claim 20, having a melting point that is less than 800° C.

22. The composition according to claim 20, wherein the at least one salt having strontium as a cation is selected from the group consisting of strontium halide, strontium carbonate ($SrCO_3$) and strontium nitrate ($Sr(NO_3)_2$).

23. The composition according to claim 20, wherein the at least one salt having carbonate as an anion is selected from the group consisting of group I carbonates and group II carbonates.

24. The composition according to claim 20, wherein the at least one salt having halide as an anion is selected from group I halides.

25. The composition according to claim 20, wherein the at least one salt having halide as an anion is selected from the group consisting of sodium halide, potassium halide and strontium halide.

26. A method for releasing strontium into molten aluminium or aluminium-based alloy, comprising adding a composition to molten aluminium or aluminium-based alloy, wherein the composition is formed by fusing a mixture comprising at least two salts, each salt comprising a cation and an anion, at least one of the salts having strontium as the cation, at least one of the salts having carbonate as the anion and at least one of the salts having a halide as the anion.

* * * * *